US005312182A

United States Patent [19]

Mlakar et al.

[11] Patent Number: 5,312,182

[45] Date of Patent: May 17, 1994

[54] HARDENED AIRCRAFT UNIT LOAD DEVICE

[75] Inventors: Paul F. Mlakar; Joseph L. Smith, both of Vicksburg, Miss.

[73] Assignee: Jaycor, San Diego, Calif.

[21] Appl. No.: 816,309

[22] Filed: Dec. 26, 1991

[51] Int. Cl.[5] ..... A47B 96/00

[52] U.S. Cl. ..... 312/409; 312/140; 312/293.3

[58] Field of Search ..... 312/409, 138.1, 139.2, 312/140, 293.3; 220/23.6, 1.5, 350

[56] References Cited

U.S. PATENT DOCUMENTS

| | | | |
|---|---|---|---|
| 948,521 | 2/1910 | Payne | 312/139.2 |
| 1,259,153 | 3/1918 | Standish | 312/409 |
| 1,788,905 | 1/1931 | Barnes | 312/139.2 |
| 2,739,730 | 3/1956 | Jonas | 220/350 |
| 2,884,296 | 4/1959 | Meilinger et al. | 312/140 |
| 3,180,697 | 4/1965 | Mulch | 312/293.3 |
| 3,490,824 | 1/1970 | Bartlett et al. | 312/138 |
| 3,736,035 | 5/1973 | Brown et al. | 312/138 R |
| 4,046,439 | 9/1977 | Lee | 312/139.2 |

FOREIGN PATENT DOCUMENTS

| | | | |
|---|---|---|---|
| 0106938 | 3/1939 | Australia | 312/140 |

*Primary Examiner*—Victor N. Sakran
*Attorney, Agent, or Firm*—Nydegger & Associates

[57] ABSTRACT

A hardened load carrying device includes a unitarily constructed container for holding the load. The container has an opening which is partially bordered by a slot that includes opposed crooked thumbs which project into the channel of the slot. A door for covering the opening of the container has a pair of opposed crooked fingers which are attached along part of the edge of the door to establish a bite. To enclose the load in the container the bite of the door is slidingly received into the slot bordering the opening to cover the opening and engage the crooked fingers of the door with the crooked thumbs of the slot. In an alternate embodiment the crooked thumbs of the slot are replaced by opposed lips which extend inwardly to establish a T-shaped slot, and the crooked fingers and the door are replaced by a flange which is slidingly received into the T-shaped slot. Any joints which are established between panels of the container are reinforced using a double thickness of material. In response to an explosive blast inside the container, the bite on the door interlocks with the slot on the container to grip the bite with the slot. Together, this action and the reinforced joints resist a rupturing of the load carrying device.

25 Claims, 4 Drawing Sheets

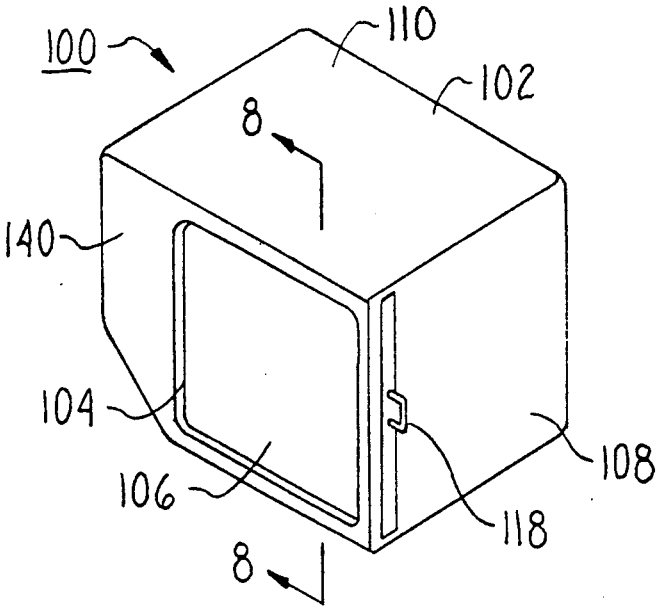
Fig. 6
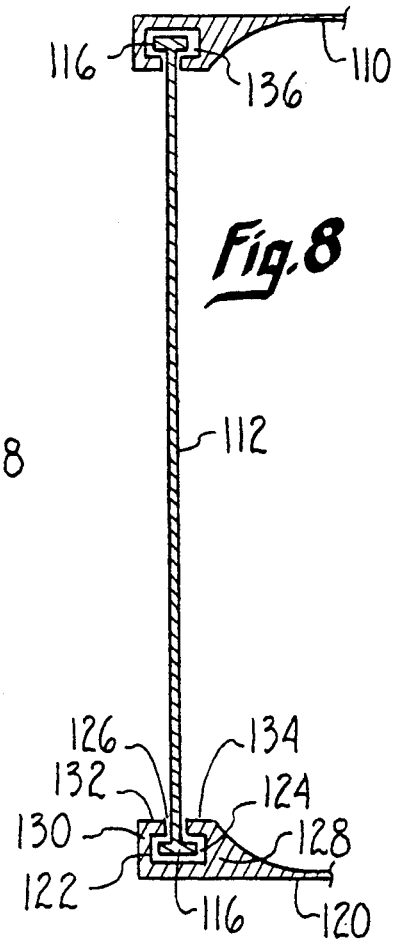
Fig. 8
Fig. 7
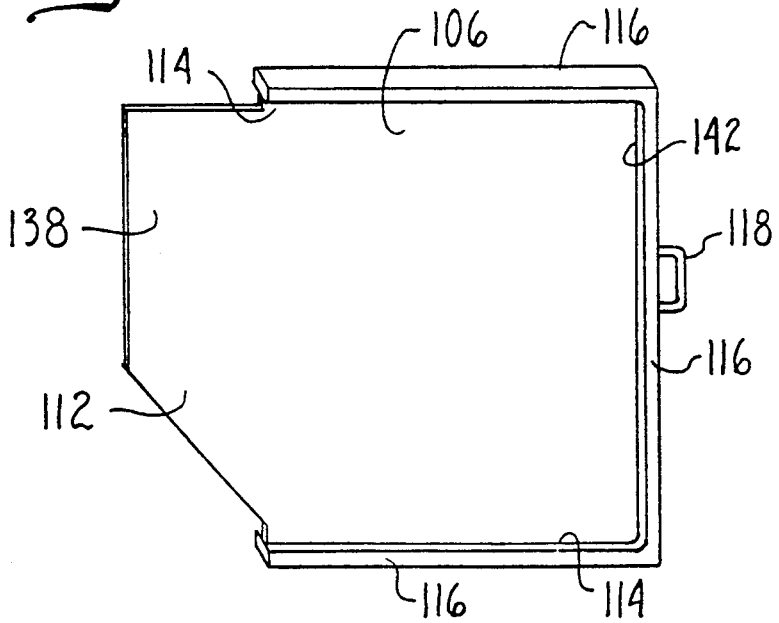

HARDENED AIRCRAFT UNIT LOAD DEVICE

FIELD OF THE INVENTION

The present invention pertains to load carrying containers. More particularly, the present invention pertains to load carrying containers which will resist the blast effect of an explosive detonation inside the container. The present invention is particularly, but not exclusively, useful as a container for carrying luggage and other cargo during transport by aircraft.

BACKGROUND OF THE INVENTION

It is an unfortunate fact that terrorists often attempt to influence the course of political events through the use of violence. One infamous means for implementing these violent actions is by strategically placing bombs where they will cause the greatest devastation and have the greatest political impact. Indeed, bombs almost seem to be a terrorist weapon of choice. As is well known, terrorist targets are typically chosen on the basis of their vulnerability to such attack and are frequently, if not purposefully, selected without regard for human life. Crowds of people can, therefore, be an attractive terrorist target due to the intense public reaction that mass murder will provoke. Further, vehicles are attractive targets because they are compact and will almost always contain people when they are being operated. Aircraft effectively combine these attractions.

Despite extremely tight security procedures, and the use of sophisticated explosive detecting electronic equipment, it happens that bombs have still found their way aboard aircraft. Typically, it has happened that bombs have been found hidden in passenger luggage or in parcels which are stored and carried in the cargo compartment of an aircraft. There is, of course, a limit to the size of bomb which can be relatively easily detected. Consequently, one strategy is to recognize that small bombs may not always be detected and then plan on ways in which to reduce the damage which can be caused by a small bomb.

Within the airline industry it is a standard practice to compartmentalize the cargo which is to be carried onboard the larger aircraft. This is done by separating the cargo into separate units and placing these units of cargo into individual containers which are commonly referred to as unit load devices (ULDs). Because of regulatory requirements, as well as practical considerations, the shape, size and weight of a ULD for each type aircraft has been pretty much standardized. Consequently, in order to design a ULD which will meet the standard requirements of the industry, and still effectively withstand a substantially large blast from an explosion in the cargo held within the ULD, these limitations need to be considered.

Typically, ULDs are shaped as boxes which can include appropriately sloped surfaces that conform the ULD to the aircraft's fuselage when the ULD is placed in the aircraft's cargo compartment. Essentially, the container is made of several panels which are joined together to form the ULD. Additionally, each ULD has a door or an access hatch which allows it to be opened for placing cargo in the ULD or for removing cargo from the ULD.

From studies which have been conducted to determine how a standard ULD will react to an internal explosion, it is known that the panels which form the container of the ULD will tend to bulge outwardly from the blast. Further, it is known that panels are relatively strong in structurally resisting the tensile stresses which are directed in the plane of the panel. Stated differently, panels are relatively effective in resisting rupture. On the other hand, stress analysis shows that the highest stress concentrations which result from an explosion within the ULD occur at the joints and around the door or hatch which covers the opening into the ULD. One obvious means for providing a hardened ULD is to simply add more material at the points where the highest stress concentrations occur. It is preferable, however, to avoid this additional weight. Instead, though some reinforcing material may be selectively used, the present invention recognizes that a proper design for the components of the ULD, and a proper design for the interaction of these components, are effective in helping solve the presently existing problems.

In light of the above it is an object of the present invention to provide a hardened load carrying device for use in transporting cargo on aircraft which is able to resist internal blasts without rupturing. Another object of the present invention is to provide a hardened load carrying device which selectively incorporates reinforcing material at the points where an internal explosion generates the highest stress concentrations in the device. Yet another object of the present invention is to provide a hardened load carrying device which meets the regulatory standards for the use of such devices in air transport operations. Still another object of the present invention is to provide a hardened load carrying device which allows relative easy access into the device through an opening which can be effectively covered without compromising the efficacy of the device. Another object of the present invention is to provide a hardened load carrying device which is easy to use, relatively easy to manufacture, and comparatively cost effective.

SUMMARY OF THE INVENTION

In accordance with the present invention, a hardened load carrying device for holding luggage and cargo during air transport includes a container which is formed by a plurality of panels. Preferably, the panels are substantially flat and are formed with additional material at their peripheries. For purposes of the present invention, they are joined together along their respective peripheries to form a box-like container of unitary construction which has reinforced joints.

The container is formed with an opening through which luggage and cargo can be placed in, or removed from, the container, and a slot borders at least part of the opening. The slot itself is formed with a channel which has a pair of opposed and substantially parallel rims. Each of the rims has a lip which extends over part of the channel and each lip has a protrusion which projects part way into the channel. Together, these lips and their associated protrusions establish a pair of opposed crooked thumbs for the slot. As so positioned in the channel, a slit is created between the thumbs.

A door for covering the opening of the container, and for holding luggage or cargo in the container, includes a bite which is formed along portions of the edge of door. This bite includes a flange which is attached substantially perpendicular to the edge of the door panel and which projects therefrom in opposed directions. Further, the flange has a pair of extensions, each of which are on opposite sides of the door panel and which are oriented substantially parallel to the door panel. The extensions thus overlap the door panel to establish a pair of opposed crooked fingers.

As intended for the present invention, the slot bordering the opening of the container is dimensioned to slidably receive the bite of the door. Thus, the door can be engaged with the container to cover the opening and enclose the load in the container. Importantly, due to the interlocking relationship between the crooked thumbs of the slot and the crooked fingers of the bite, the slot grips the bite in response to an explosive blast within said container to resist rupturing of the device.

Preferably, the hardened load carrying device is made of a blast resistive material, such as an epoxy or resin SPECTRA composite. Further, the container of the device is preferably of unitary construction and any additional strengthening material which may be needed is used selectively and only at points where relatively high stress concentrations are anticipated.

In an alternate embodiment of the present invention, the crooked thumbs of the slot on the container and the crooked fingers of the bite on the door are replaced with other interlocking structures. Specifically, the protrusions from the lips in the slot which formed the crooked thumbs are eliminated. Thus, for this alternate embodiment the slot is substantially a T-shaped channel. Further, the flanges at the edge of the door remain, but the extensions from these flanges which formed the crooked fingers are eliminated. With this structure, the flanges are slidingly received in a cooperative T-shaped slot to interlock the door with the container. In all other important respects the preferred embodiment and the alternate embodiment are substantially equivalent. It is also to be noted that for either embodiment of the present invention the door can be made to engage the container and through the center panel of the container (i.e. slide horizontally) rather than through the top or overhead panel (i.e. slide vertically).

The novel features of this invention, as well as the invention itself, both as to its structure and its operation will be best understood from the accompanying drawings, taken in conjunction with the accompanying description, in which similar reference characters refer to similar parts, and in which:

BRIEF DESCRIPTION OF THE DRAWINGS

FIG. 6 is a perspective view of an alternate embodiment of the hardened load carrying device of the present invention;

FIG. 7 a perspective view of the door of the alternate embodiment of the hardened load carrying device of the present invention; and FIG. 8 a cross-sectional view of the alternate embodiment of the present invention as seen along the line 8—8 in FIG. 6 with portions eliminated for clarity.

DESCRIPTION OF THE PREFERRED EMBODIMENTS

Figure 1:
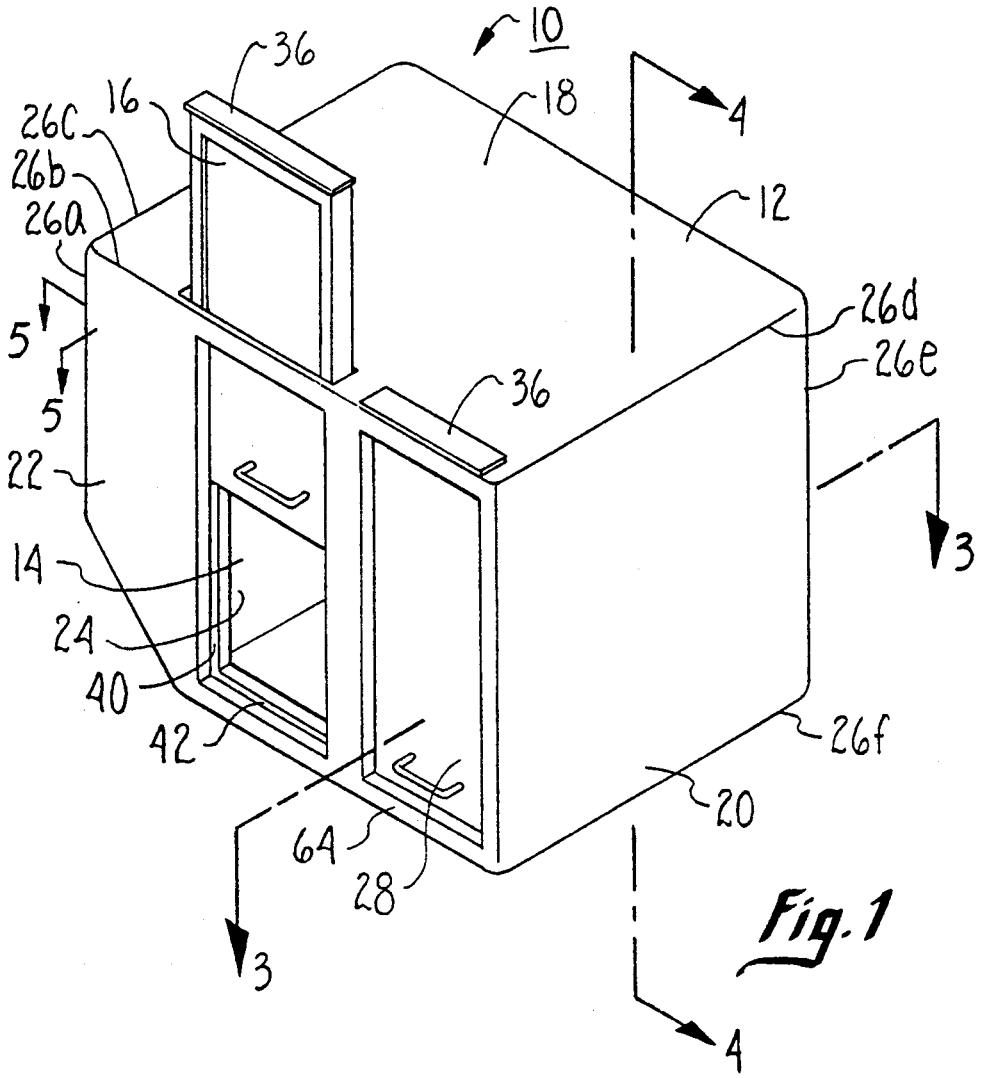
FIG. 1 perspective view of the hardened load carrying device of the present invention.

Referring initially to FIG. 1, the hardened unit load device (HULD) of the present invention is shown and is generally designated 10. As seen in FIG. 1, HULD 10 includes a container 12 which is formed with an opening 14. Although the actual size and configuration of the HULD 10 can be varied to meet specified space requirements, the particular configuration shown in figure is readily adaptable for use with most aircraft. This HULD 10 has a box-like shaped container 12 that is made using a plurality of substantially flat panels. For HULD 10, the top panel 18, center panel 20, front panel 22, and sloped panel 24 are exemplary. These, and the other panels which are necessary to create container 12, are connected to each other at joints 26 a,b,c etc. along their respective peripheries where the panels intersect each other. Further, front panel 22 is shown with two doors, the door 16 and a second door 28.

Importantly, the material used for the construction of container 12, and the doors 16, 28, should exhibit a very high strength to weight ratio and offer high impact strength, thermal stability, chemical resistance and relatively low flammability and off-gas emissions. Such a material is commercially available and is marketed under product names KEVLAR or SPECTRA. Preferably, the SPECTRA material used for HULD 10 is provided as a reinforced epoxy or resin SPECTRA laminate which can be molded to establish a container 12 having a unit body structure. Preliminary estimates indicate that many layers (perhaps as many as twelve to twenty five layers, depending on the particular weave) of SPECTRA fabric may be required to withstand approximately one and a half (1.5) lb of TNT. These estimates also indicate that a HULD 10 capable of withstanding such a blast would have a tare weight of approximately one thousand (1,000) lb and the panels would be approximately thirty two one hundredths (0.32) inches thick. Containers 12 having lower tare weights will, of course, be less tolerant to blasts.

Figure 2:
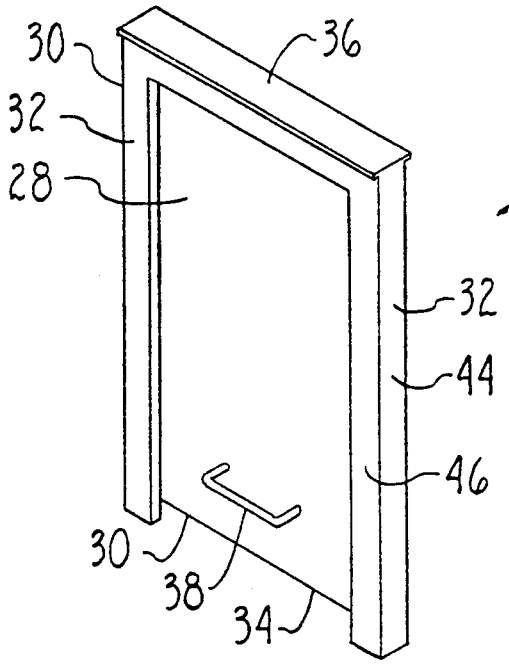
FIG. 2 a perspective view of a door for the hardened load carry device shown in FIG. 1.

FIG. 2 shows that the edge 30 of door 28 includes a bite 32 which extends around the edge 30 of door 28. The bottom edge 34 of door 28, however, is not formed with the bite 32. Additionally, an overlap 36 is formed along the bite 32 at the top of door 28, and the door 28 is provided with a device, such as the handle 38, which allows the door 28 to be manipulated. Returning for the moment to FIG. 1, there it will be seen that the opening 14 is partially bordered by a slot 40 and a detent 42. The interaction between the edge 30 and bite 32 of door 16, or door 28, and the slot 40 and detent 42 which border the opening 14 will be best appreciated with reference to FIGS. 3 and 4.

Figure 3:
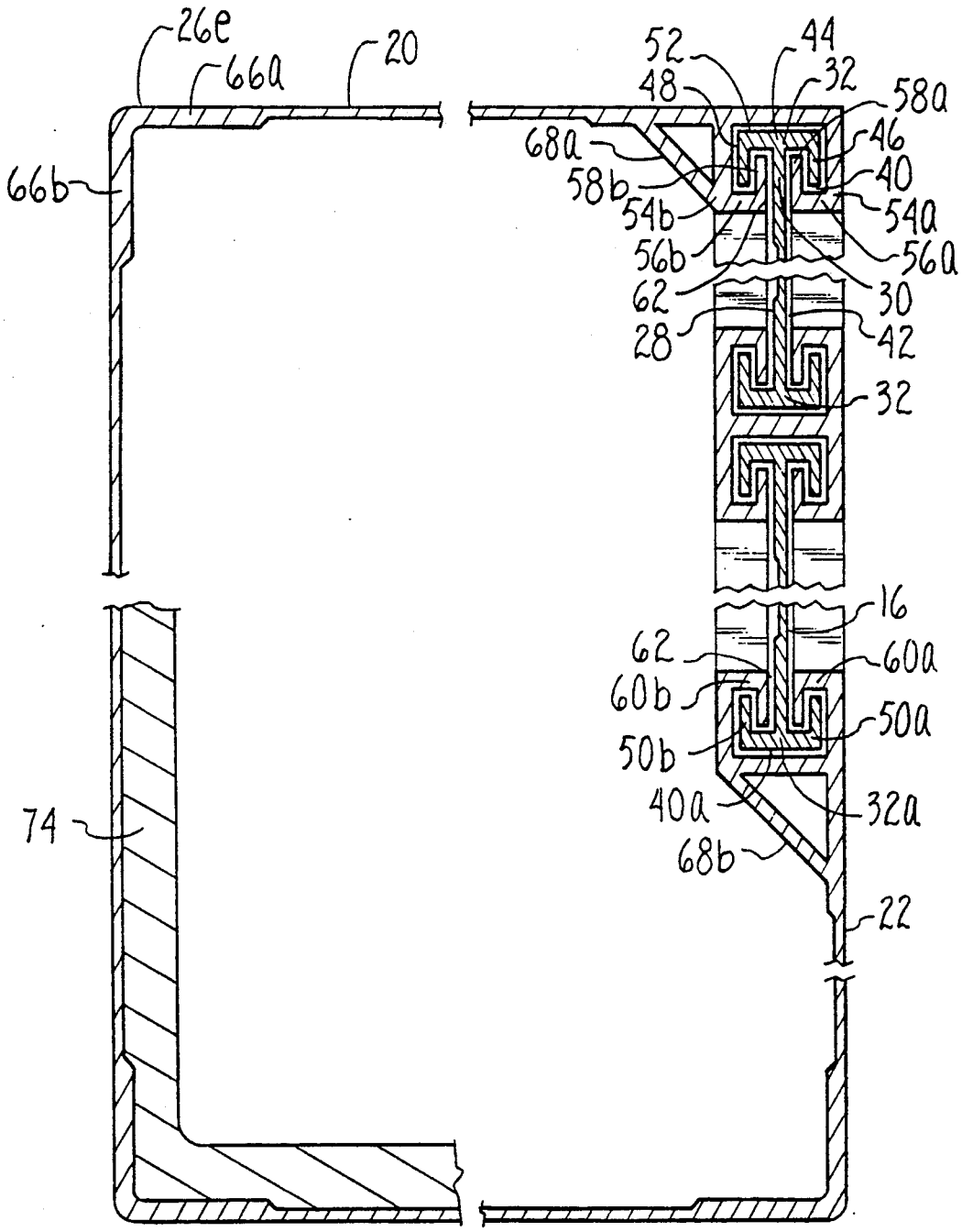
FIG. 3 cross-sectional view of the device as seen along t 3—3 in FIG. 1 with portions of the device or compactness and clarity in the figure.

The door 28 shown in FIG. 3, and its interaction with the container 12, is representative of other similar structure disclosed for HULD 10 of the present invention. Specifically, FIG. 3 shows that the bite 32 includes a flange 44 which is integrally attached to the edge 30 of door 28. The flange 44 is oriented substantially perpendicular to the plane of the door panel 28 and extends in opposite directions from the edge 30. Extensions 46 and 48 are integrally attached to the flange 44, as shown, and each extension 46,48 is oriented substantially parallel to the door panel 28. With this structure, the bite 32 is seen to include a pair of oppositely disposed crooked fingers 50*a* and 50*b*. For clarity, the crooked fingers 50*a* and 50*b* are identified in FIG. 3 as being formed as part of the door panel 16. As this interchangeability suggests, it is to be understood that the bite 32 on door 16 and the bite 32 of door 28 are substantially similar.

Still referring to FIG. 3, it can be seen that the slot 40 which borders an opening into the container 12 (e.g. opening 14) is formed to include a channel 52. The channel 52 has a pair of opposed rims 54*a* and 54*b*, and also has a pair of lips 56*a* and 56*b* which respectively extend out and over the channel 52 from the rims 54*a* and 54*b*. The protrusions 58*a* and 58*b* project part way into the channel 52, respectively from the lips 56*a* and 56*b* substantially as shown in FIG. 3, to establish a pair of opposed crooked thumbs 60*a* and 60*b* for the slot 40. With this structure, a slit 62 is established between the thumbs 60*a* and 60*b*.

Figure 4:
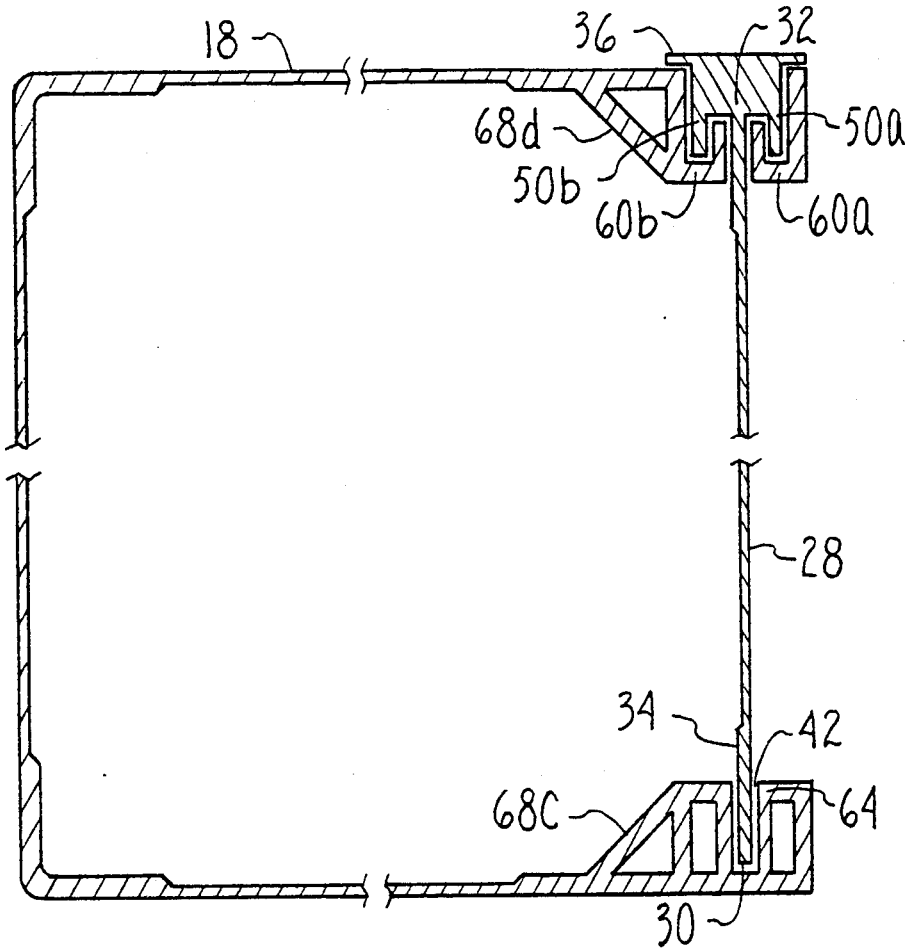
FIG. 4 is a cross-sectional view of the device as seen along the line 4—4 in FIG. 1 with portions of the device removed compactness and clarity in the figure.

The cooperation between the bite 32 and the slot 40 is perhaps best appreciated by cross referencing FIGS. 3 and 4. When making this cross reference, it is to be appreciated that the door 16 and 28 are substantially similar, as are the openings which they respectively cover. In FIG. 3 it can be appreciated that the bite 32 on door 28 slidingly engages with the slot 40 which borders the opening into the container 12. More specifically, the fingers 50*a* and 50*b* of bite 32 interlock with the thumbs 60*a* and 60*b* of slot 40. Further, in FIG. 4 it will be seen that similar structure causes fingers 50*a* and 50*b* to interlock with thumbs 60*a* and 60*b* at the top of door 28 when the door 28 is fully engaged with the container 12 to completely cover the opening with the door 28.

As shown in FIGS. 2 and 4, the bottom 34 of door 28 is not formed with a bite 32. Instead, the edge 30 is left exposed at the bottom 34 of door 28. Further, the bottom 64 of the opening which is covered by door 28 is not formed with a slot 40. Instead, the bottom 64 is formed with a detent 42. Accordingly, as shown in FIG. 4, when door 28 is fully engaged with the container 12 to completely cover the opening, edge 30 at the bottom 34 of door 28 is inserted into the detent 42 at the bottom 64 of the opening. Additionally, when door 28 is fully engaged with the container 12, the overlap 36 rests against the outer surface of top panel 18.

Figure 5:
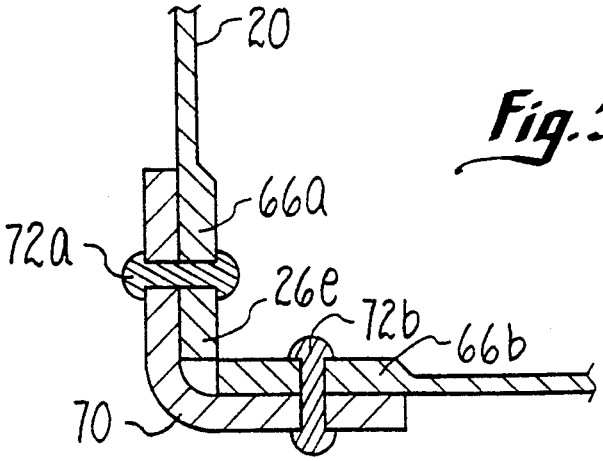
FIG. 5 cross sectional view of an alternate embodiment for of the device as seen along the line 5—5 in portions removed for clarity.

The joints 26, which are established at the intersections of the panels that form container 12, are all reinforced in a manner similar to the structure shown in FIG. 3 for individual joint 26*e*. This reinforcing is accomplished by providing additional material in the areas 66*a* and 66*b* that are adjacent to the bend in the joint 26*e*. For purposes of the present invention, the thickness of the areas 66*a* and 66*b* around joint 26*e* is approximately twice the thickness of the remainder of the panels. This is done to satisfy structural stress analysis which indicate that the blast from an explosive which is detonated inside the container 12 will cause high stress concentrations around the joints 26. Additional strength can also be provided around the openings (e.g. opening 14) by establishing cross braces 68*a*, 68*b*, 68cand 68*d*, substantially as shown in FIGS. 3 and 4. In an alternate embodiment for the joints 26, e.g. joint 26*e* shown in FIG. 5, the joint 26 is not integral. Instead, and end plate 70 is used to join the abutting panels. As shown, the areas 66*a* and 66*b* again have a thickness which is approximately twice that for the rest of their respective panel and the endplate 70 has a thickness which is approximately equal to the thickness in the areas 66*a* and 66*b*. For this embodiment, fasteners well known in the pertinent art, such as the rivets 72*a* and 72*b*, hold the endplate 70 against the areas 66 of the panels to establish the joints 26.

FIG. 3 also indicates that the interior of container 12 can be covered with a crushable foam liner 74. Though liner 74 is shown covering only a portion of the interior of the container 12, it is to be understood that the entire interior surface of container 12, as well as the inside surfaces of the doors 16 and 28, can be covered with the liner 74. As intended for use with HULD 10, liner 74 can be made of any suitable material which will crush in response to an explosive blast and thereby absorb energy that would otherwise be directly imparted to the structural panels of the container 12. Additionally, if venting is provided for HULD 10, the crushable liner 74 will help mitigate the blast load which is felt by the interior of the container 12.

As is well known to the skilled artisan, proper venting can be incorporated into the design of container 12 to appropriately reduce the effect of the blast. The particular size and location of vents for the container 12 are a matter of design choice and can be varied according to the desires of the manufacturer. Regardless whether container 12 is vented, if it does not rupture from an internal explosion, the aggregate effect of a blast will be minimized both inside and outside the container 12 and, in most cases, the resultant damage can be effectively controlled.

As envisioned for the HULD 10 of the present invention, in the event an explosive device (not shown) is somehow positioned inside the HULD 10, an explosion of this device will be stifled by the HULD 10. This is so for several reasons. Firstly, the resin or epoxy SPECTRA composite material preferably used in the manufacture of the HULD 10, has superior strength characteristics. Additionally, SPECTRA is known to be an effective material for resisting puncture or rupture. Secondly, as mentioned above, the use of a crushable liner 74 has some obvious advantages for reducing the impact of the blast. Thirdly, and very importantly, the structural design of the HULD 10 for the interaction between the doors 16 and 28, and the container 12 causes these structures to cooperatively resist an internal blast.

In order to appreciate the interaction of the doors 16, 28 with the container 12, consider the effect of a blast inside the container 12. Such a blast will create pressure against the doors 16, 28 and tend to force them outwardly. Consequently, the doors 16, 28 will bulge and the edges 30 at the top and bottom of the doors 16, 28 will be drawn toward each other. Similarly, the edges 30 along the sides of the doors 16, 28 will be drawn toward each other. When this happens, the bite 32 along the edge 30 of the doors 16, 28 will be driven into the slot 40. This causes the bite 32 to grip with the slot 40. The overall result is that the resistive forces are distributed all along the edge 30 to reduce the possibility of a blow out of the doors 16, 28 or an unacceptable rupture at the interface between the doors 16, 28 and the respective openings which they cover.

An alternate embodiment for the hardened unit load device of the present invention is shown in FIG. 6 and is generally designated 100. As shown, the device 100 includes a container 102 that is formed with an opening 104 through which articles, packages and luggage (not shown) can be placed in the container 102. Also, FIG. 6 shows that the opening 104 of container 102 can be covered by a door 106. In a slightly different arrangement than was previously disclosed above for the container 12, the door 106 is engageable with the container 102 to slide over the opening 104 from the direction of the center panel 108 (i.e. slide horizontally), rather than from the direction of the top panel 110 (i.e. slide vertically). In most all other important respects, the construction of the container 102 is substantially similar to the construction of the container 12. Specifically, the panel structure and the joint structure for the device 100 are the same as for the device 10. The interlock between the door 106 and the container 102, however, is modified from what was previously disclosed for the engaging structure between the container 12 and the doors 16,28.

In order to appreciate the structural cooperation between the door 106 and the container 102, first consider the door 106. As shown in FIG. 7, door 106 includes a panel 112 which is similar to the panels which are used in the manufacture of the container 12 or the container 102. Further, the panel 112 has an edge 114 and a flange 116 is attached along parts of the edge 114 substantially as shown. The flange 116 may, of course, be integral with the panel 112. As can be appreciated by reference to FIG. 7, the combination of flange 116 and panel 112 forms a substantially T-shaped structure. A handle 118 may be provided assist an operator in the engagement of the door 106 with the container 102.

The actual engagement of the door 106 with the container 102 will, perhaps, be best appreciated with reference to FIG. 8. There it will be seen that a bottom panel 120 of the container 102 is formed with a T-shaped slot 122. Specifically, the slot 122 is a space which includes an open channel 124 and a slit 126. More specifically, the bottom panel 120 includes a pair of opposed rims 128 and 130 which extend substantially perpendicular from the plane of the panel 108. Also, a lip 132 and a lip 134 respectively extend from the lips 128 and 130 toward each other to form the T-shaped slot 122. Importantly, the dimensions of T-shaped slot 122 are such that they allow flange 116 to be slidingly received into the channel 124 of slot 122, and they allow the panel 112 of door 106 to pass through the slit 126 of slot 122. FIG. 8 also shows that top panel 110 of container 100 has a T-shaped slot 136 which is similar in structure to the slot 126.

Referring back to FIG. 7 it will be seen that the panel 112 of door 106 is formed with a flap 138. For the present invention, it is intended that the flap 138 extend behind front panel portion 140 (shown in FIG. 6) when the door 106 is closed onto container 102. Also, it is to be appreciated that, when door 106 is closed, the surface 142 on that portion of flange 116 which is opposite flap 138 will abut against center panel 108. Thus, panel 112 will resist an explosive blast within the container 102 through the interaction of flange 116 with slot 136 in top panel 110, the interaction of flange 116 with slot 122 in bottom panel 112, the abutment of flange 116 against center panel 108 and the abutment of flap 138 against front panel portion 140.

For the operation of the container 100, the door 106 can easily slide horizontally (i.e. perpendicularly to the center panel 108) to allow the operator access into the container 100. Once door 106 is closed the device 100 will resist the effect of an explosive blast within the container 102 through the various cooperations of structure described above.

While the particular hardened unit load carrying device as herein shown and disclosed in detail is fully capable of obtaining the objects and providing the advantages herein before stated, it is to be understood that it is merely illustrative of the presently preferred embodiments of the invention and that no limitations are intended to the details of the construction or design herein shown other than as defined in the appended claims.

We claim:

1. A hardened unit load carrying device which comprises:
   - a container for holding said load, said container being formed with an opening defining a channel means;
   - a door having an edge;
   - a flanged gripping means formed on said door along a portion of said edge; and
   - said channel means consisting of interlocking means bordering said opening for slidably receiving at least part of said gripping means of said door in an interlocking fashion, to cover said opening with said door and enclose said load in said container;
   - wherein said gripping means and said interlocking means interlock with increased force in response to an explosive blast within said container to resist rupturing said device.

2. A device as recited in claim 1 wherein said container is formed with a plurality of panel, each said panel defining a periphery and being joined with other of said panels along their respective peripheries to form said container with reinforced joints established between said panels, at least one said panel being formed with said opening.

3. A device as recited in claim 2 wherein each said panel has a first thickness and said joints have a second thickness which is approximately twice said first thickness.

4. A device as recited in claim 3 wherein said container is of unitary construction.

5. A device as recited in claim 1 wherein at least part of said gripping means is formed as a crooked finger.

6. A device as recited in claim 1 further comprising a crushable liner positioned to cover the inside of said container.

7. A device as recited in claim 1 wherein said gripping means is a flange attached substantially perpendicular to said edge and projecting therefrom in opposed directions.

8. A hardened unit load carrying device which comprises:
   - a container for holding said load, said container being formed with an opening;
   - a door having an edge;
   - a flanged gripping means formed on said door along a portion of said edge; and
   - means bordering said opening for slidably receiving at least part of said gripping means of said door, to cover said opening with said door and enclose said load in said container, and for engaging with said gripping means in response to an explosive blast within said container to resist rupturing said device;
   - wherein at least part of said gripping means is formed as a crooked finger; and
   - wherein said means bordering said opening includes a crooked thumb for interlocking with said crooked finger.

9. A device as recited in claim 8 wherein said edge of said door is formed with a bite, said bite including a flange attached substantially perpendicular to said edge of said panel and projecting therefrom in opposed directions, said flange having a pair of extensions, each said extension being oriented substantially parallel to said door panel and overlapping said door panel to establish a pair of opposed crooked fingers for said bite.

10. A device as recited in claim 9 wherein said opening is at least partially bordered by a slot, said slot being a channel formed with a pair of opposed rims, each said rim having a lip extending over part of said channel and each lip having a protrusion projecting part way into said channel to create a slit therebetween and to establish a pair of opposed crooked thumbs for said slot, said slot of said container being dimensioned to slidably receive said bite of said door to cover said opening with said door and enclose said load in said container, and to interlockingly grip said slot with said bite in response to an explosive blast within said container.

11. A device as recited in claim 10 wherein said door and said opening are substantially rectangular, and said bite is formed along three sides of said door to leave an exposed edge on one side of said door, and said slot borders three sides of said opening, said opening having a groove contiguous with said slot and extending along one side of said opening for receiving said exposed edge of said door therein when said door covers said opening.

12. A hardened unit load carrying device which comprises:

a container for holding said load, said container being formed with an opening;

a door having an edge;

a flanged gripping means formed on said door along a portion of said edge; and means bordering said opening for slidably receiving at least part of said gripping means of said door, to cover said opening with said door and enclose said load in said container, and for engaging with said gripping means in response to an explosive blast within said container to resist rupturing said device;

wherein said gripping means is a flange attached substantially perpendicular to said edge and projecting therefrom in opposed directions; and wherein said opening is at least partially bordered by a slot, said slot being a channel formed with a pair of opposed rims, each said rim having a lip extending over part of said channel to create a slit therebetween, said slot of said container being dimensioned to slidably receive said flange of said door to cover said opening with said door and enclose said load in said container, and to interlockingly grip said slot with said flange in response to an explosive blast within said container.

13. A device as recited in claim 12 wherein said slot is T-shaped.

14. A hardened load carrying device which comprises:

a plurality of panels, each said panel defining a periphery and being joined with other of said panels along their respective peripheries to form a container with reinforced joints established between said panels, at least one said panel having an opening, said opening being at least partially bordered by a slot, said slot being a channel formed with a pair of opposed rims with each said rim having a lip extending therefrom over part of said channel; and a door having an edge, at least part of said edge being formed with a flange slidably engageable with said slot to cover said opening with said door and enclose said load in said container, and to hold said flange of said door against said lip of said slot for said door to grip said container in response to an explosive blast within said container.

15. A device as recited in claim 14 wherein each said lip further comprises a protrusion projecting part way into said channel to create a slit therebetween and to establish a pair of opposed crooked thumbs for said slot and wherein said edge of said door formed with a bite, said bite including said flange, said flange being attached substantially perpendicular to said edge of said door panel and projecting therefrom in opposed directions, said flange having a pair of extensions, each said extension being oriented substantially parallel to said door panel and overlapping said door panel to establish a pair of opposed crooked fingers of said bite, said slot of said container being dimensioned to slidably receive said bite of said door to cover said opening with said door and enclose said load in said container, and to interlockingly grip said slot with said bite in response to an explosive blast within said container.

16. A device as recited in claim 15 wherein said door and said opening are substantially rectangular, and said bite is formed along three sides of said door to leave an exposed edge on one side of said door, and said slot borders three sides of said opening, said opening having a groove contiguous with said slot and extending alone one side of said opening for receiving said exposed edge of said door therein when said door covers said opening.

17. A device as recited in claim 14 wherein said panels are substantially flat.

18. A device as recited in claim 14 wherein each said panel has a first thickness and said joints have a second thickness which is approximate twice said first thickness.

19. A hardened load carrying device which comprises:

a door panel having an edge formed with a flange attached substantially perpendicular to said edge of said panel and projecting therefrom in opposed directions; and a container for holding said load, said container being formed with an opening at least partially bordered by a slot, said slot being a channel formed with a pair of opposed rims, each said rim having a lip extending over part of said channel to create a slit therebetween, said slot of said container being dimensioned to slidably receive said flange of said door to cover said opening with said door and enclose said load in said container, and to interlockingly grip said lip of said slot with said flange of said door in response to an explosive blast within said container to resist rupturing said device.

20. A device as recited in claim 19 wherein said flange having a pair of extensions, each said extension being oriented substantially parallel to said door panel and overlapping said door panel to establish a pair of opposed crooked fingers to establish a bit and each said lip of said slot has a protrusion projecting part way into said channel to create a slit therebetween and to establish a pair of opposed crooked thumbs for said slot, said thumbs being engageable with said slot.

21. A device as recited in claim 20 wherein said door and said opening are substantially rectangular, and said bite is formed along three sides of said door to leave an exposed edge on one side of said door, and said slot borders three sides of said opening, said opening having a groove contiguous with said slot and extending along one side of said opening for receiving said exposed edge of said door therein when said door covers said opening.

22. A device as recited in claim 19 wherein said container comprises a plurality of panels, each said panel defining a periphery and being joined with other of said panels along their respective peripheries to form a container with reinforced joints established between said panels.

23. A device as recited in claim 19 wherein each said panel has a first thickness and said joints have a second thickness which is approximate twice said first thickness.

24. A device as recited in claim 19 wherein said container is of unitary construction.

25. A device as recited in claim 19 wherein said container and said door are made of SPECTRA.

* * * * *